US005782243A

United States Patent [19]

Bisyak

[11] Patent Number: 5,782,243

[45] Date of Patent: Jul. 21, 1998

[54] VARIABLE POSITION INTERCOURSE PERFORMANCE APPARATUS

[76] Inventor: Steven Bisyak, P.O. Box 639, Tracyton, Wash. 98393

[21] Appl. No.: 900,604

[22] Filed: Jul. 25, 1997

[51] Int. Cl.[6] ..... A61G 15/00

[52] U.S. Cl. ..... 128/845; 128/846; 600/38

[58] Field of Search ..... 28/845, 846, 842, 28/844, 918; 600/38–40; 5/89.1, 83.1, 120, 122

[56] References Cited

U.S. PATENT DOCUMENTS

| | | | |
|---|---|---|---|
| 4,002,368 | 1/1977 | Ortiz | 5/120 |
| 4,748,701 | 6/1988 | Marlowe | 5/89.1 |
| 4,825,855 | 5/1989 | Kundson, Jr. | 128/79 |
| 4,903,355 | 2/1990 | Hickerson | 5/89.1 |
| 5,161,522 | 11/1992 | Clevenger | 128/25 R |
| 5,280,794 | 1/1994 | Degen | 128/845 |
| 5,294,176 | 3/1994 | Asinovsky | 297/245 |
| 5,385,154 | 1/1995 | Fuhrum et al. | 128/845 |
| 5,389,062 | 2/1995 | Mitchum, Jr. | 600/38 |
| 5,453,080 | 9/1995 | Mitchum, Jr. | 600/38 |
| 5,538,011 | 7/1996 | Craft | 128/845 |
| 5,586,560 | 12/1996 | Boutos | 128/845 |

*Primary Examiner*—Michael A. Brown
*Attorney, Agent, or Firm*—Dean A. Craine

[57] ABSTRACT

An apparatus is provided for performing intercourse in different positions, including an adjustble, fixed length main strap, an elastic strap, an upper torso harness attached to one end of the elastic strap capable of independently supporting the shoulders of a participant, a lower torso harness attached to one end of the elastic strap capable of independently supporting the lower torso of the participant, and at least one, adjustable leg harness attached to one end of the elastic strap capable of supporting at least one leg of the participant. The upper, first end of the main strap is attached to an elevated surface and suspended vertically therefrom. A carabeaner is used to attach the upper end of the elastic strap to the lower end of the main strap. Attached to the opposite lower end of the elastic strap are two carabeaners which are used to selectively connected the upper, lower and leg harnesses to the elastic strap. By using independently the three harnesses to position the body in a suspended position, the participants may easily position themselves in a wide variety of sexual desirable positions with less fatigue and discomfort.

7 Claims, 2 Drawing Sheets

VARIABLE POSITION INTERCOURSE PERFORMANCE APPARATUS

BACKGROUND OF THE INVENTION

1 . Field of the Invention

This invention relates to apparatus used to comfortably support the human body during a physical activity, and, more particularly, to such apparatus used to comfortably support the human body during sexual intercourse.

2. Description of the Related Art

It is well known that participants in sexual intercourse often try a variety of different positions to achieve maximum physical stimulation. In some instances, these positions may be difficult to obtain or uncomfortable to maintain during the sexual act.

It is also well known that many handicapped individuals desire to be sexually active. Unfortunately, their physical handicaps often limit their sexual activity and the number of positions that may used during sexual intercourse.

Ideally, an apparatus is needed which helps participants during sexual intercourse to obtain and maintain a wide variety of different sexual positions.

SUMMARY OF THE INVENTION

It is an object of the present invention to provide an apparatus for use during intercourse.

It is another object of the invention to provide such an apparatus that enables participants to obtain and comfortably maintain a large variety of sexual positions.

These and other objects are met by providing a variable position, intercourse performance apparatus which includes a fixed, length adjustable main strap that attaches at one end to an elevated surface or ceiling, an elastic strap that enables a participant to bounce vertically that attaches to the opposite end of the main strap, an upper torso harness selectively attached to the lower, second end of the elastic strap designed to comfortably support the shoulders or upper torso region of a participant in a suspended manner from the end of the elastic strap, a lower torso harness selectively attached to lower end of the elastic strap designed to comfortably support the lower torso of the participant in a suspended manner from the end of the elastic strap, and at least one adjustable, leg harness selectively attached to lower end of the elastic strap designed to comfortably support at least one leg of the participant in a suspended manner from the end of the elastic strap.

The main strap, which is made of durable, non-elastic material, is adjustable in length in approximately 2 inch increments. The elastic strap is made sufficiently elastic material to safely support the participant in a suspended position from the elevated surface yet allow the participant to gently bounce vertically when disposed in the apparatus. The upper and lower harness may be used by themselves or together. Each leg harness is also adjustable in length. By using different combinations of the four components and adjusting the length of the leg harnesses, the participant may be positioned in a wide variety of sexually desirable positions with little or no fatigue.

More particularly, the upper torso harness includes left and right shoulder straps capable of being disposed comfortably around the left and right shoulders, respectively. The lower torso harness includes a seat with a connecting strap having approximately the same length as the shoulder straps so that the upper harness and seat are suspending approximately the same distance from the lower end of the elastic strap. The leg harnesses are adjustable in length so that the participant may be disposed in a sitting, genucubital (knee-elbow) or a genucpectoral (knee-chest) position. Both legs harness can also be removed thereby enabling the participant to be only supported by the upper and lower torso harnesses. Also, the upper torso and leg harnesses can be removed thereby enabling the participant to be supported by the lower torso harness.

DESCRIPTION OF THE PREFERRED EMBODIMENT(S)

Shown in the accompanying FIGS. 1–5, there is shown a apparatus, generally referred to as 10, designed to enable participants perform sexual intercourse in a wide variety of different positions with less fatigue and discomfort.

Figure 1:
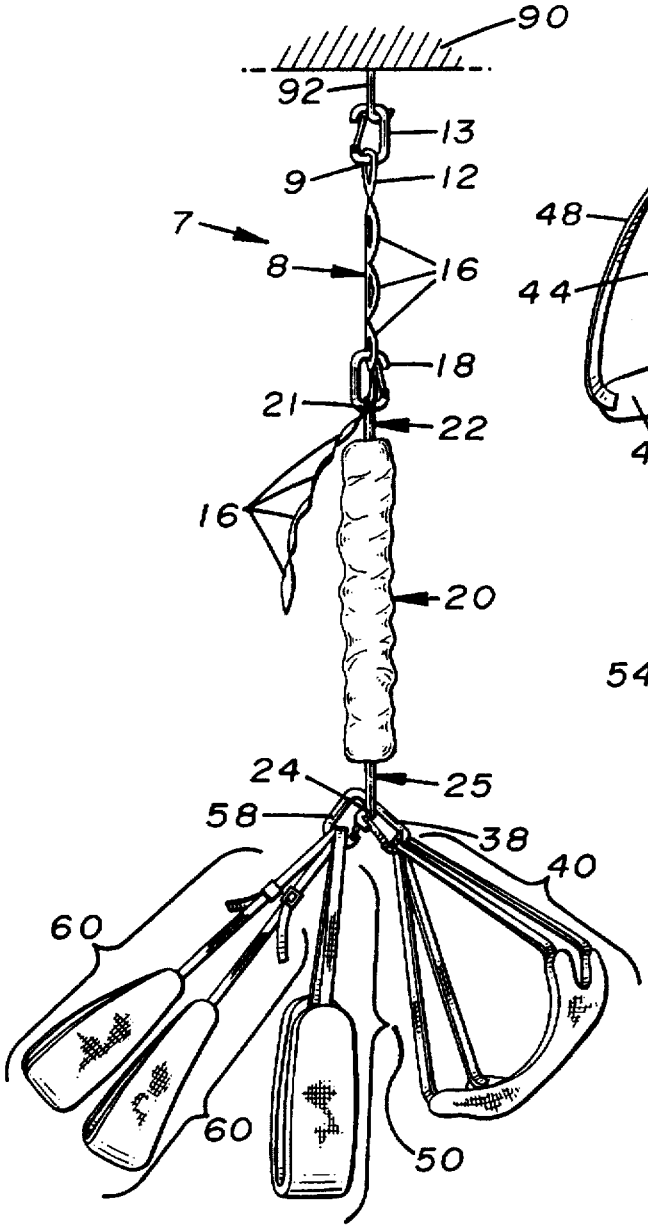
FIG. 1 is a perspective view of the invention disclosed herein.

As shown more clearly in FIG. 1, the apparatus 7 includes a main strap 8, an elastic strap 20, an upper torso harness 40, a lower torso harness 50, and at least one leg harness 60. The main strap 8 has an upper first end 9 with an upper loop 12 formed thereon and and a plurality of lower loops 16 located there below. The upper loop 12 may be attached directly to a hook 92 attached to an elevated surface or ceiling 90 of a room. Alternatively, the upper loop 12 may be attached to an attachable connector, such as first carabeaner 13. In the preferred embodiment, the main strap 8 is made durable nylon webbing material. The lower loops 16 are formed longitudinally along the main strap 8 each designed to be engaged with a second carabeaner 18. By connecting the second carabeaner 18 to different lower loops 16 along the main strap 8, the effective length of the main strap 8 can be adjusted.

During assembly, the desired length of main strap 8 is determined. One of the lower loops 16 located at the desired position on the main strap 8 is selected and a second carabeaner 18 is attached thereto. The first end of the elastic strap 20 is then attached to the second carabeaner 18.

Figure 5:
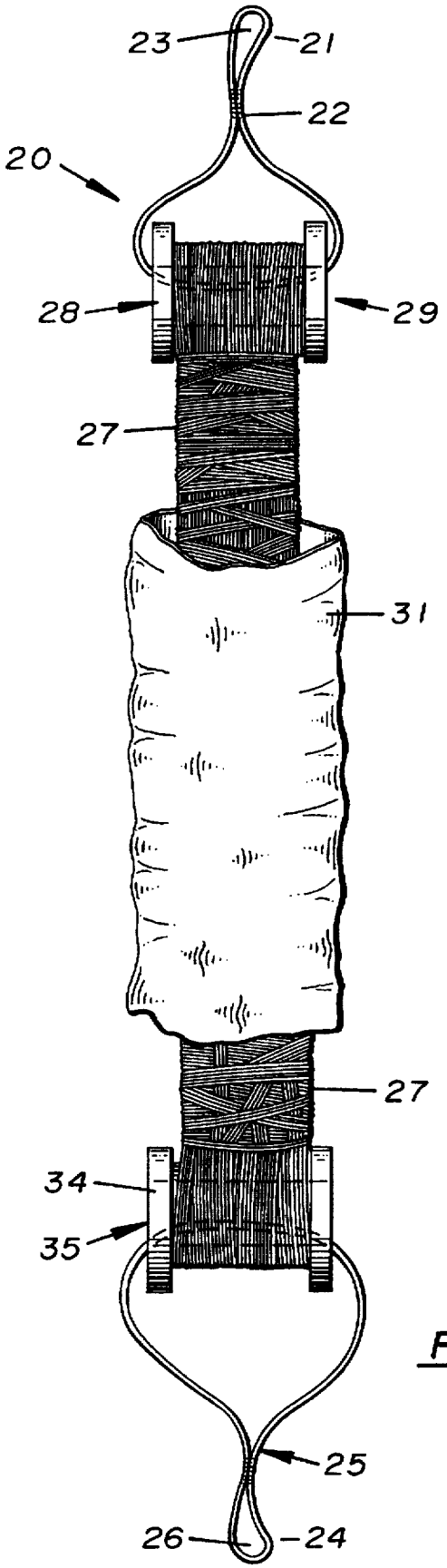
FIG. 5 is a side elevational view, partially removed, of the elastic strap.

As shown in FIG. 5, the elastic strap 20 includes an upper spool 30 and a lower spool 34 with an elastic member 27 disposed between them. In the preferred embodiment, the elastic member 27 is made of 100% extruded latex material, similar to the material used to manufacture BUNGEE cords. Each spool 30, 34, has a longitudinally aligned central passageway 29, 35, respectively. During assembly, the upper and lower strap components 22, 27 extend through the central passageways, 29, 35, respectively. Each strap component 22, 27 has a loop 23, 26, respectively, formed thereon, which connects to the second and third, fourth carabeaners 18, 38, 54, respectively. Disposed around the spools 30, 34 and elastic member 27 is an outer cover 31. The outer cover 31 is made of lubricant resistant material, such as nylon.

As mentioned above, a third and fourth carabeaners 38, 58, respectively, are attached to the loop 26 on the lower strap component 25. Attached to the third carabeaner 38 is an upper torso harness 40. Attached to the fourth carabeaner 58 is a lower harness and one or two leg harnesses 60.

Figure 2:
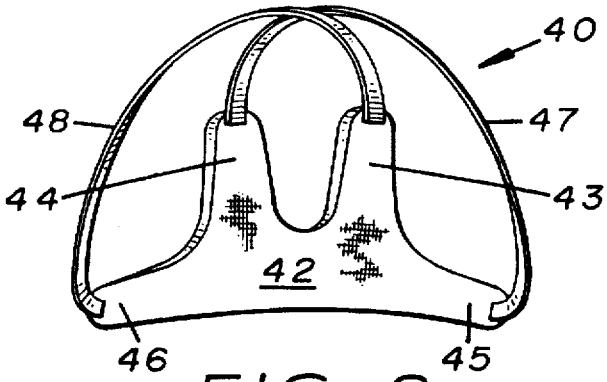
FIG. 2 is a side elevational view of the upper torso harness.

As shown in FIG. 2, the upper torso harness 40 includes a pad 42 and two straps 47, 48. The pad 42 includes two upper arm members 43, 44 and two lateral arm members 45, 46. During assembly, the opposite ends of strap 47 are attached to the upper arm member 44 and lateral arm member 45, while the opposite ends of strap 48 are attached to the upper arm member 43 and lateral arm member 46. The third carabeaner 38 is placed around the two straps 47, 48 to connect the upper torso harness 40 to the elastic strap 22.

Figure 3:
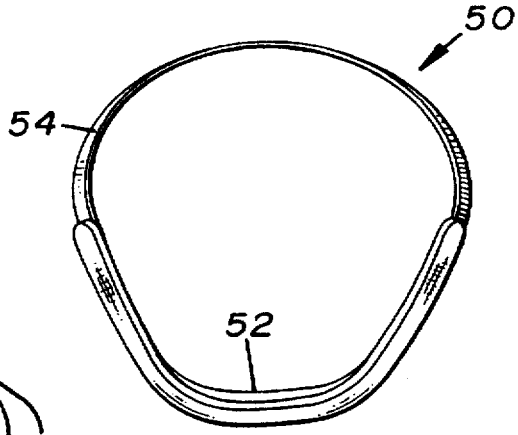
FIG. 3 is a side elevational view of the lower torso harness.

As shown in FIG. 3, the lower torso harness 50 comprises a pad 52 with a strap 54 attached to the opposite ends of the pad. During assembly, the fourth carabeaner 58 is disposed around the strap 54 to attach the lower torso harness 50 to the elastic strap 22.

Figure 4:
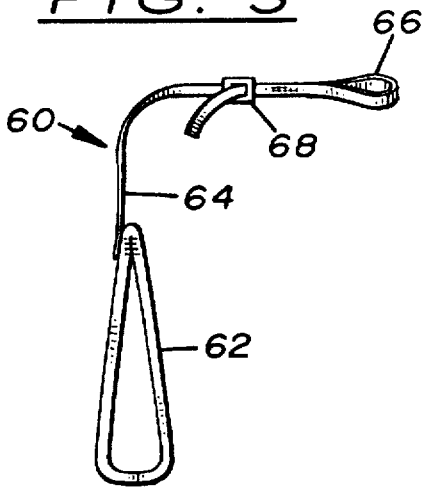
FIG. 4 is a side elevational view of a leg harness.

As shown in FIG. 4, each leg harness 60 comprises a pad 62 and an adjustable strap 64 with a loop 66 formed at its distal end. During assembly, the opposite ends of the pad 62 are attached together to form a closed loop structure through which a participant's lower or upper leg may be inserted. The proximal end of the strap 64 is attached to the formed apex region of the pad 62. A buckle 68 is attached to the strap 64 which enables the strap 64 to be adjusted in length. The fourth carabeaner 58 is attached to the loop 66 to connect the leg harness 60 to the elastic strap 20.

To use the apparatus 7, a hook 92 is connected at a desirable location on the ceiling 90. The first carabeaner 13 is then attached to the upper loop 12 on the main strap 8 and then connected to the hook 92. The desired length of the main strap 8 is then determined and the second carabeaner 18 is then connected to the adjacent lower loop 16. The loop 23 on the upper strap component 22 on the elastic strap 20 is then connected to the second carabeaner 18 to connect the first end 21 of the elastic strap 20 to the second end 10 of the main strap 8. The third and fourth carabeaners 38, 58, respectively, are then attached to the loop 26 on the elastic strap 20.

In order to obtain different, desirable sexual positions, the upper, lower and leg harnesses, 40, 50, 60, respectively, are selectively attached and detached from the third and fourth carabeaners 38, 58. The upper and lower torso harness 40, 50 are designed to support the participant's upper and lower torsos, either in supine or prone horizontal positions. Each leg harness 60 can be positioned anywhere along the participant's leg and can be adjusted in length to hold the leg either at the same elevation or at an elevation above or below the upper and lower torso.

The use of four carabeaners 13, 18, 38, 58 enables the apparatus 7 to be quickly and easily assembled. The carabeaners 13, 18, 38, 58, enable the apparatus 7 to rotate and swing around hook 92. The elastic strap 20 also allows the apparatus 7 to bounce vertically.

In compliance with the statute, the invention, described herein, has been described in language more or less specific as to structural features. It should be understood, however, the invention is not limited to the specific features shown, since the means and construction shown comprised only the preferred embodiments for putting the invention into effect. The invention is, therefore, claimed in any of its forms or modifications within the legitimate and valid scope of the amended claims, appropriately interpreted in accordance with the doctrine of equivalents.

I claim:

1. An apparatus for performing intercourse, comprising:

a. a main strap, said main strap having a first end and a second end, b. a main strap first end connecting means located at said first end of said main strap capable of selectively attaching said first end of said main strap to an elevated surface;

c. an elastic strap, said elastic strap having a first end and a second end;

d. a main/elastic strap connecting means disposed between said main strap and said first end of said elastic strap;

e. an elastic strap end connecting means attached to said elastic strap;

f. an upper harness capable of attaching to said second end of said elastic strap, said upper harness capable of supporting one or both shoulders of a participant placed therein;

g. a lower harness capable of attaching to said second end of said elastic strap, said lower harness capable of supporting the lower torso of a participant placed therein; and, h. at least one leg harness capable of attaching to said second end of said elastic strap, said leg harness capable of supporting at least on leg of the participant.

2. An apparatus as recited in claim 1, wherein said main strap first end connecting means includes a loop formed on said main strap and carabeaner.

3. An apparatus as recited in claim 1, wherein said main/elastic strap connecting means is plurality of loops formed on said main strap, an upper loop formed on said elastic strap, and a carabeaner capable of interconnecting one said loop on said main strap and said upper loop on said elastic strap.

4. An apparatus as recited in claim 1, wherein said main strap is made of nylon material.

5. An apparatus as recited in claim 1, wherein said elastic strap is made of extruded latex.

6. An apparatus as recited in claim 1, wherein said upper harness is designed to support both the left and right shoulders of the participant.

7. An apparatus as recited in claim 1, wherein said lower harness is a seat pad with a strap attached thereto capable of being disposed under the lower torso of a participant.

* * * * *